US011441864B1

(12) United States Patent
Garwood

(10) Patent No.: US 11,441,864 B1
(45) Date of Patent: Sep. 13, 2022

(54) SAFING SECTOR AND METHOD OF USE

(71) Applicant: TMP Weapons, LLC, Reno, NV (US)

(72) Inventor: Tracy Warren Garwood, Reno, NV (US)

(73) Assignee: TMP Weapons, LLC, Reno, NV (US)

( * ) Notice: Subject to any disclaimer, the term of this patent is extended or adjusted under 35 U.S.C. 154(b) by 0 days.

(21) Appl. No.: 17/318,922

(22) Filed: May 12, 2021

(51) Int. Cl.
*F41A 17/56* (2006.01)

(52) U.S. Cl.
CPC ..... *F41A 17/56* (2013.01)

(58) Field of Classification Search
CPC ..... F41A 17/56
See application file for complete search history.

(56) References Cited

U.S. PATENT DOCUMENTS 3,380,341 A * 4/1968 Chiabrandy ..... F41F 1/10 89/12
3,766,821 A * 10/1973 Cozzy ..... F41F 1/10 89/149
7,013,789 B2 * 3/2006 Dillon ..... F41F 1/10 89/12
7,703,374 B1 * 4/2010 Dillon ..... F41A 17/32 89/12
7,971,515 B2 * 7/2011 Garwood ..... F41A 9/31 89/12
10,816,294 B2 * 10/2020 Todd, II ..... F41A 19/68
2021/0116206 A1 * 4/2021 Schira ..... F41F 1/10

* cited by examiner

*Primary Examiner* — Joshua T Semick
(74) *Attorney, Agent, or Firm* — Procopio Cory Hargreaves and Savitch LLP

(57) ABSTRACT

A safing sector for a minigun including a housing with an opening adjacent to barrels of the minigun, comprising a safing sector cover configured to cover the opening of the housing of the minigun; one or more retaining pin assemblies configured to retain the cover to the housing of the minigun; a safing sector slide member configured to slide forward and rearward relative to the safing sector cover; a safing sector slide control mechanism configured to impart the forward and rearward sliding movement of the safing sector slide member relative to the safing sector cover between at least a fire position and a safe position, where the barrels of the minigun may be rotated electrically without firing and without bolt assemblies becoming damaged.

19 Claims, 7 Drawing Sheets

SAFING SECTOR AND METHOD OF USE

FIELD OF THE INVENTION

The present invention relates to safing sectors for firearms.

SUMMARY OF THE INVENTION

An aspect of the invention involves a safing sector that easily and quickly renders a M134 minigun safe or fire without having to remove components from the assembly. The one inseparable assembly of the safing sector compared to the six removable components of the prior safing sector that could be lost, rendering the minigun non-functional, prevents essential components from being lost. By not removing components and simply sliding the searing surface back, the minigun allows rotation without striking the primer while also preventing a jam in the minigun.

Another aspect of the invention involves a safing sector for a minigun including a housing with an opening adjacent to barrels of the minigun, comprising a safing sector cover configured to cover the opening of the housing of the minigun; one or more retaining pin assemblies configured to retain the cover to the housing of the minigun; a safing sector slide member configured to slide forward and rearward relative to the safing sector cover; a safing sector slide control mechanism configured to impart the forward and rearward sliding movement of the safing sector slide member relative to the safing sector cover between at least a fire position and a safe position, where the barrels of the minigun may be rotated electrically without firing and without bolt assemblies becoming damaged.

One or more implementations of the aspect of the invention described immediately above includes one or more of the following: the safing sector cover includes one or more guide members and the safing sector slide member includes one or more guide members operatively associated with the one or more guide members of the safing sector cover to enable forward and rearward sliding movement of the safing sector slide member relative to the safing sector cover; the one or more guide members of the safing sector slide member includes a plurality of outwardly extending guide members and the one or more guide members of the safing sector cover includes a plurality of inwardly extending guide members; the safing sector slide control mechanism includes a movable arm configured to impart forward and rearward sliding movement of the safing sector slide member relative to the safing sector cover; the movable arm is configured to impart rearward sliding movement of the safing sector slide member relative to the safing sector cover when the arm is raised; the movable arm is configured to impart forward sliding movement of the safing sector slide member relative to the safing sector cover when the arm is lowered; the movable arm is configured to impart rearward and forward sliding movement of the safing sector slide member relative to the safing sector cover between at least two positions: a fire position, and a safe position; the movable arm is configured to impart rearward and forward sliding movement of the safing sector slide member relative to the safing sector cover between at least three positions: a fire position, a safe position, and an install/uninstall position; the movable arm includes a spring-loaded latch to latch and unlatch the movable arm relative to the safing sector slide member; the safing sector slide control mechanism includes a cam mechanism configured to impart forward and rearward sliding movement of the safing sector slide member relative to the safing sector cover; and/or the one or more retaining pin assemblies include a spring-loaded latch to latch and unlatch the one or more retaining pin assemblies relative to the safing sector cover.

A further aspect of the invention involves a method of using a safing sector for a minigun including a housing with an opening adjacent to barrels of the minigun, the safing sector including a safing sector cover configured to cover the opening of the housing of the minigun; one or more retaining pin assemblies configured to retain the cover to the housing of the minigun; a safing sector slide member configured to slide forward and rearward relative to the safing sector cover; a safing sector slide control mechanism configured to impart the forward and rearward sliding movement of the safing sector slide member relative to the safing sector cover, the method comprising imparting forward and rearward sliding movement of the safing sector slide member relative to the safing sector cover with the safing sector slide control mechanism.

One or more implementations of the aspect of the invention described immediately above includes one or more of the following: the safing sector cover includes one or more guide members and the safing sector slide member includes one or more guide members operatively associated with the one or more guide members of the safing sector cover to enable forward and rearward sliding movement of the safing sector slide member relative to the safing sector cover, and the method further comprising sliding the safing sector cover forward and rearward relative to the safing sector cover via the one or more guide members of the safing sector slide member and the one or more guide members of the safing sector cover; the one or more guide members of the safing sector slide member includes a plurality of outwardly extending guide members and the one or more guide members of the safing sector cover includes a plurality of inwardly extending guide members, and sliding includes sliding the safing sector cover forward and rearward relative to the safing sector cover via the plurality of outwardly extending guide members of the safing sector slide member and the plurality of inwardly extending guide members of the safing sector cover; the safing sector slide control mechanism includes a movable arm configured to impart forward and rearward sliding movement of the safing sector slide member relative to the safing sector cover, and imparting includes imparting forward and rearward sliding movement of the safing sector slide member relative to the safing sector cover with the movable arm; the movable arm is configured to impart rearward sliding movement of the safing sector slide member relative to the safing sector cover when the arm is raised and is configured to impart forward sliding movement of the safing sector slide member relative to the safing sector cover when the arm is lowered, and imparting includes imparting forward and rearward sliding movement of the safing sector slide member relative to the safing sector cover with the movable arm by respectively lowering and raising the movable arm; the movable arm is configured to impart rearward and forward sliding movement of the safing sector slide member relative to the safing sector cover between at least a fire position and a safe position, and imparting includes imparting rearward and forward sliding movement of the safing sector slide member relative to the safing sector cover between at least the fire position and the safe position, where the barrels of the minigun may be rotated electrically without firing and without bolt assemblies becoming damaged; the movable arm is configured to impart rearward and forward sliding movement of the safing sector slide member relative to the safing sector cover between at least a fire position, a safe position, and an install/uninstall position, and imparting includes imparting rearward and forward sliding movement of the safing sector slide member relative to the safing sector cover between at least the fire position, the safe position, where the barrels of the minigun may be rotated electrically without firing and without bolt assemblies becoming damaged, and the install/uninstall position, where the safing section may be installed/uninstalled relative to the housing of the minigun; and/or the safing sector slide control mechanism includes a cam mechanism configured to impart forward and rearward sliding movement of the safing sector slide member relative to the safing sector cover, and imparting includes imparting forward and rearward sliding movement of the safing sector slide member relative to the safing sector cover via the cam mechanism.

BRIEF DESCRIPTION OF DRAWINGS

The accompanying drawings, which are incorporated in and form a part of this specification illustrate embodiments of the invention and together with the description, serve to explain the principles of the invention.

DESCRIPTION OF EMBODIMENT OF THE INVENTION

Figure 1A:
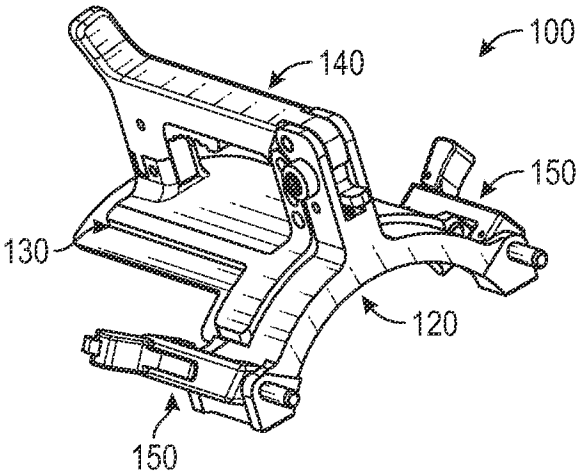
FIGS. 1A, 1B, 1C, 1D are perspective, bottom plan, side elevational, and top plan views of an embodiment of a safing sector shown in a closed or fire position.

With reference to FIGS. 1A-7, an embodiment of a safing sector 100 for a M134 minigun 110 and method of using the same will be described. The safing sector 100 easily and quickly renders the M134 minigun safe or fire without having to remove components from the assembly. The one inseparable assembly of the safing sector 100 compared to the six removable components of the prior safing sector that could be lost, rendering the minigun non-functional, prevents essential components from being lost. By not removing components and simply sliding the searing surface back, the minigun allows rotation without striking the primer while also preventing a jam in the minigun.

The safing sector 100 includes a safing sector cover 120, a safing sector slide member 130, a safing sector slide control mechanism 140, and one or more (e.g., a pair of) retaining pin assemblies 150.

The safing sector cover 120 includes a first curved section 160 and a second curved section 170.

The first curved section 160 terminates in opposite retaining pin receiving ends 175 with flanges 180 and holes 190 therein. A first locking arm receiver 200 extends vertically upward from a central portion 210 of the first curved section 160. The first locking arm receiver 200 includes a pair of spaced supports 220 having holes 230, 240, 250. Holes 230 receive dowel pin 260. Holes 240 receive one or more of set screw 270, spring 280, helicoil 290, ball 300, one or more of which carry ratchet stop 310. Holes 250 receive dowel pin 320.

The second curved section 170 includes a generally rectangular opening 330 with inner lateral edges 340 including a plurality in inwardly extending guide members 350.

The safing sector slide member 130 includes a first curved section 360 and a second curved section 370.

The first curved section 360 includes a second locking arm receiver 380 with a pair of spaced supports 390 having holes 400, 410, 420. Hole 400 receives dowel pin 430.

The second curved section 370 includes a generally rectangular plate 440 with a recessed generally rectangular undersection 450. A plurality of outwardly extending guide members 460 extend from outer lateral edges of the undersection 450. A latch receiver 470 extends upwardly from an end 480 of the safing sector slide member 130 opposite from the second locking arm receiver 380. The latch receiver 470 includes a pair of spaced vertically extending supports 485 with holes 490 that receive dowel pin 500. An end support 510 vertically extends upward from the end 480 of the second curved section 370.

The safing sector slide control mechanism 140 includes a locking arm 520 with opposite ends 530, 540. End 530 includes a flange member 550 with holes 560, 570, 580. The hole 560 is an elongated slotted hole and receives the dowel pin 430. The hole 570 receives the dowel pin 260. End 540 includes a protruding engagement member 590 and holes 600 that receive dowel pin 610. The locking arm 520 includes a recessed undersection that receives a latch mechanism 620. The latch mechanism 620 includes opposites ends 630, 640. End 630 includes a hole 650 that receives a spring 660. End 640 includes a hole 670 that receives the dowel pin 260. A latch 680 extends from the end 640.

The pair of retaining pin assemblies 150 each include a locating body 700, a locating handle 710 with a lateral hole 715, a locating latch 720, a front locating pin 730, a back locating pin 740, dowel pins 750, and a spring 760. The locating body 700 includes a raised front member 770 with a longitudinal hole 780 and a lateral hole 790, and a raised rear member 800 with a longitudinal hole 810 and a lateral hole 820. The locating body 700 includes sides 830 with a recessed section 840 therebetween that receives the locating latch 720. The longitudinal holes 780, 810 receive the front locating pin 730 and the back locating pin 740. The lateral holes 715, 790, 820 receive the dowel pins 750 for attaching the front locating pin 730 and the back locating pin 740 and the locating latch 720 to the locating body 700. The locating handle 710 includes a hole 850 that receives the spring 760 for biasing a trigger section 860 of the locating latch 720. The front locating pin 730 and the back locating pin 740 of each retaining pin assembly 150 is received within the holes 190 of the flanges 180 of the retaining pin receiving ends 175. The locating latch 720 is actuated for latching/unlatching each retaining pin assembly 150 relative to the retaining pin receiving ends 175.

A method of using the safing sector 100 with a M134 minigun 110 will now be described. The existing top cover and safing sector are removed from the M134 minigun, and replaced with the safing sector 100. The retaining pin assemblies 150 are inserted into the respective bores in the housing of the M134 minigun 110 by actuating the trigger sections 860 followed by inserting the front locating pins 730 into the respective bores of the M134 housing, and releasing the trigger sections 860 so that the springs 760 urge the locating latches 720 into a locked position, locking the safing sector 100 into the position shown in FIG. 5B.

The safing sector 100 is positionable between a closed or fire position, as shown in FIGS. 1A-1D and FIGS. 5A-5B, a safe or partial open position as shown in FIGS. 2A-2D and FIG. 6, and an install or fully open position as shown in FIGS. 5A-5D and FIG. 7.

Figure 1B:
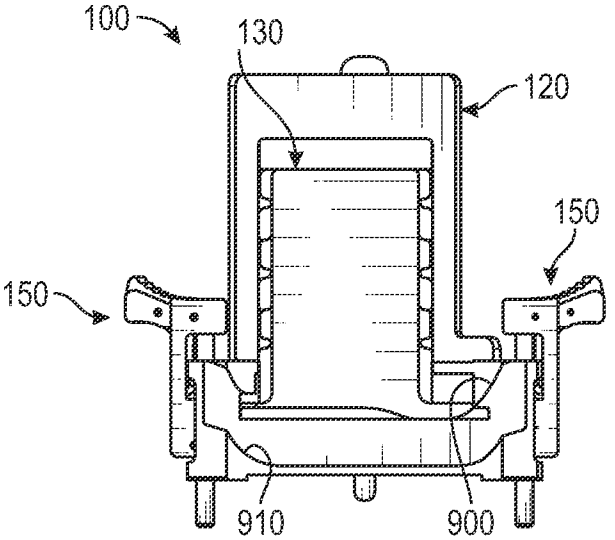
Figure 1C:
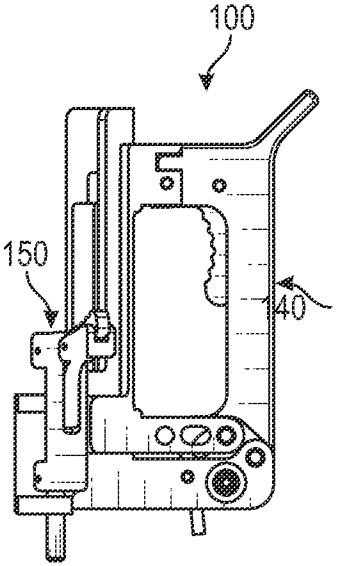
Figure 1D:
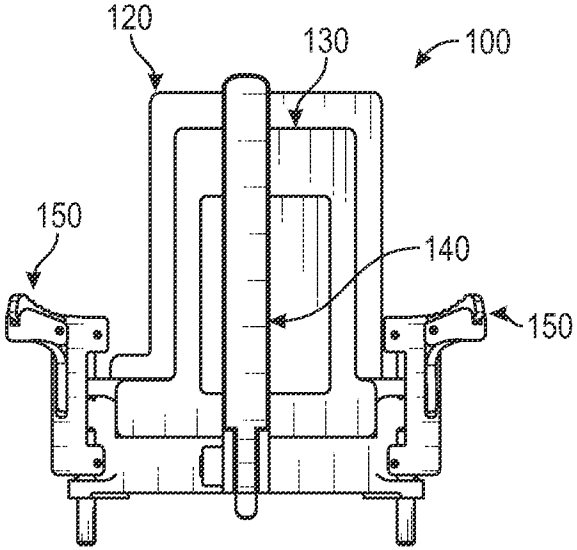

As shown in in FIGS. 1A-1D and FIGS. 5A-5B, when the safing sector 100 is positioned in the closed or fire position, the safing sector slide control mechanism 140, including the locking arm 520, is in a fully down and locked position and the ratchet stop 310 is engaged with respect to the end 530 of the locking arm 520. In this position, the latch 680 of the locking arm 520 is latched to the dowel pin 500 and the safing sector slide member 130 is in a fully forward position. With reference to FIG. 1B, in the fully forward position, as the barrels of the M134 minigun 110 rotate, the forward camming section 900 forces the bolt assemblies forward so that the firing pin of each bolt assembly is placed under heavy spring pressure in preparation for firing a respective cartridge. The aft camming section 910 forces the bolt assembly in the aft direction, guiding the bolt assembly back into the helical tracking within the main housing of the M134 minigun.

Figure 2A:
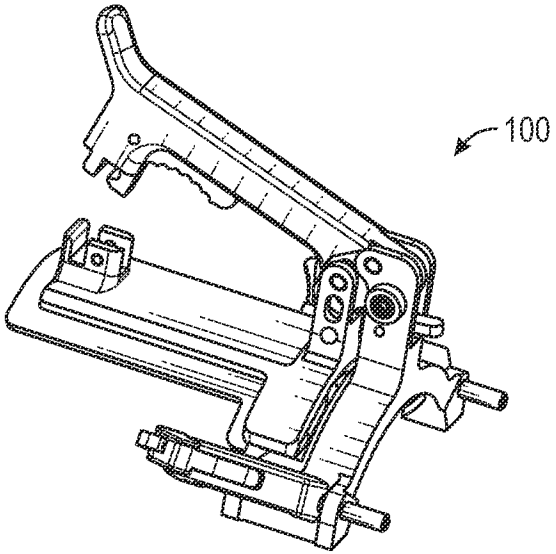
FIGS. 2A, 2B, 2C, 2D are perspective, bottom plan, side elevational, and top plan views of the safing sector of FIGS. 1A-1D shown in a safe or partial open position.
Figure 2C:
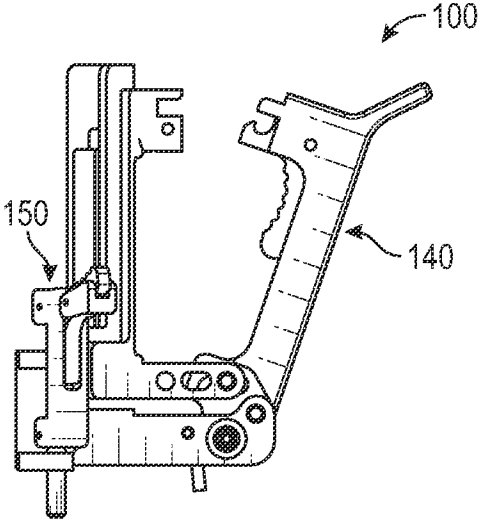
Figure 2B:
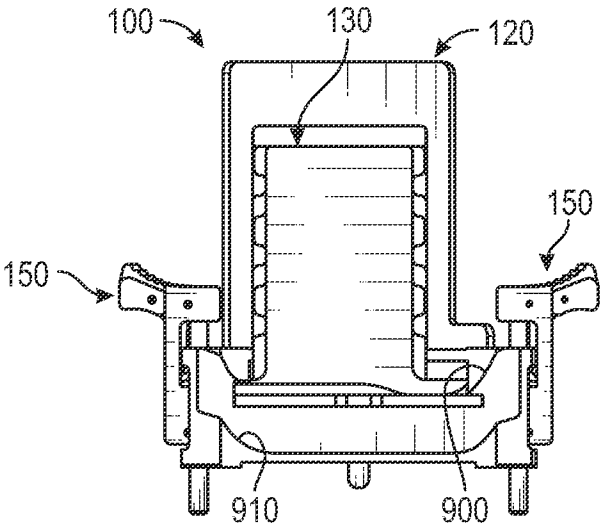
Figure 2D:
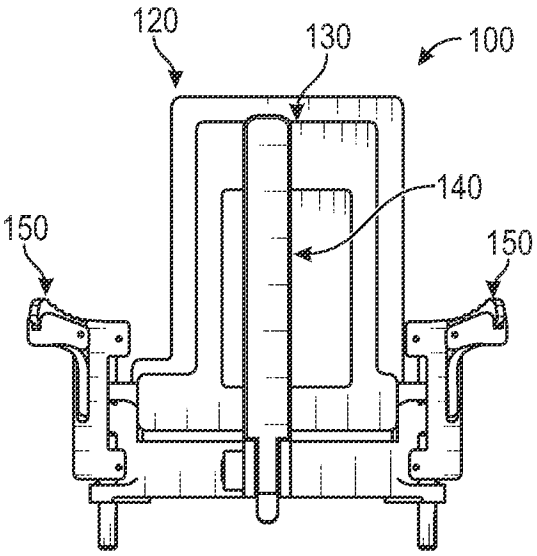

The safing sector 100 is positioned in the safe or partial open position shown in FIGS. 2A-2D and FIG. 6 by disengaging the ratchet stop 310 with respect to the end 530 of the locking arm 520 and lifting the safing sector slide control mechanism 140, including the locking arm 520, to the partially open position shown. The latch mechanism 620 of the locking arm 520 is disengaged/unlatched from the dowel pin 500 by pulling up on the end 630. Lifting of the locking arm 520 to the position shown causes the internal sidewalls of the portion of the locking arm 520 forming the elongated curved slot/hole 560 to act as a camming surface (the elongated curved slot/hole 560 and the dowel pin 430 form a camming mechanism) that forces the dowel pin 430 and, hence, the safing sector slide member 130 to slide partially rearward. The outwardly extending guide members 460 of safing sector slide member 130 are slidingly meshed with the inwardly extending guide members 350 of the safing sector cover 120 to allow sliding of the safing sector slide member 130 relative to the safing sector cover 120 via operation of the safing sector slide control mechanism 140, including the locking arm 520. With reference to FIG. 2B, in the partial rearward position, when the M134 minigun 110 is safed, as the barrels of the M134 minigun 110 rotate, the forward camming section 900 is removed from the overall length of the helical track, while aft camming section 910 is left in place. Consequently, the barrels of the M134 minigun 110 may be rotated electrically without it firing and without the bolt assemblies becoming damaged. The safing sector 100 is positioned in the closed or fire position shown in FIGS. 1A-D and FIGS. 5A-5B by disengaging the ratchet stop 310 with respect to the end 530 of the locking arm 520 and lowering the safing sector slide control mechanism 140, including the locking arm 520, to the closed or fire position shown. This causes the safing sector slide member 130 to move forward relative to the safing sector cover 120 in an opposite manner to that described immediately above.

Figure 3A:
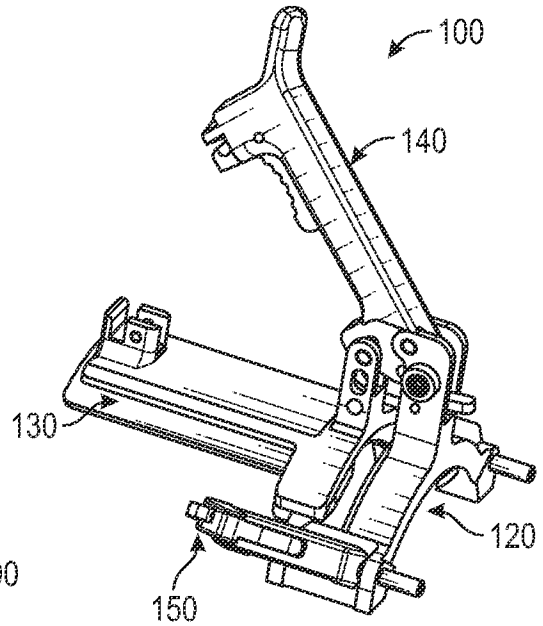
FIGS. 3A, 3B, 3C, 3D are perspective, bottom plan, side elevational, and top plan views of the safing sector of FIGS. 1A-1D shown in an install or fully open position.
Figure 3D:
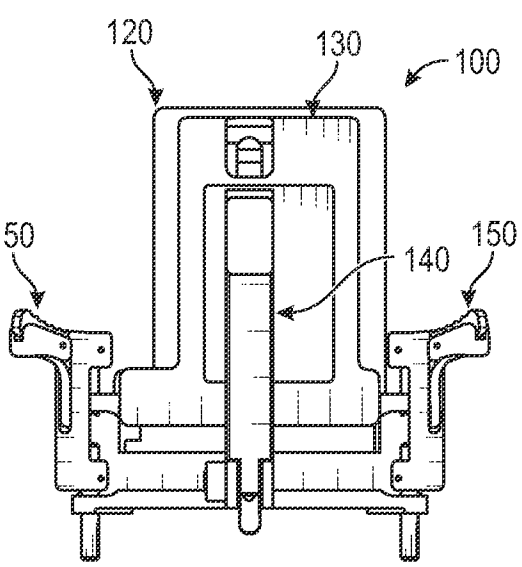
Figure 3C:
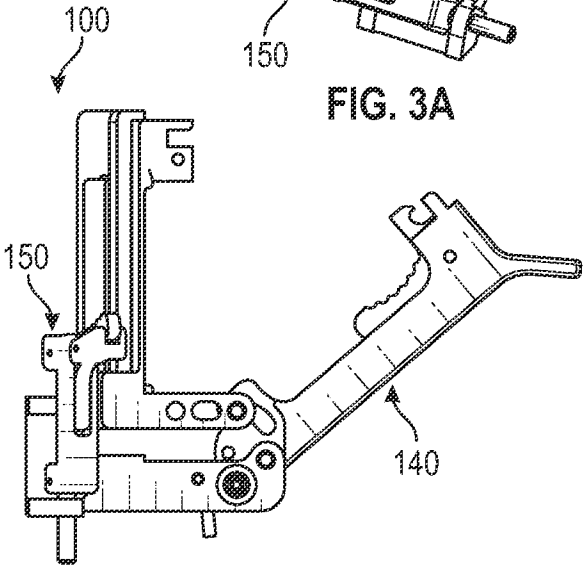
Figure 3B:
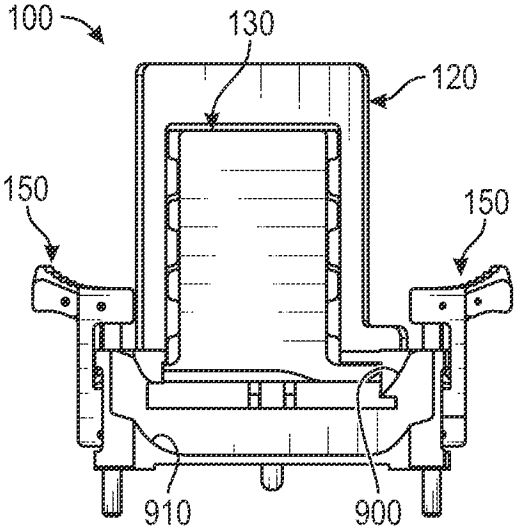
Figure 4:
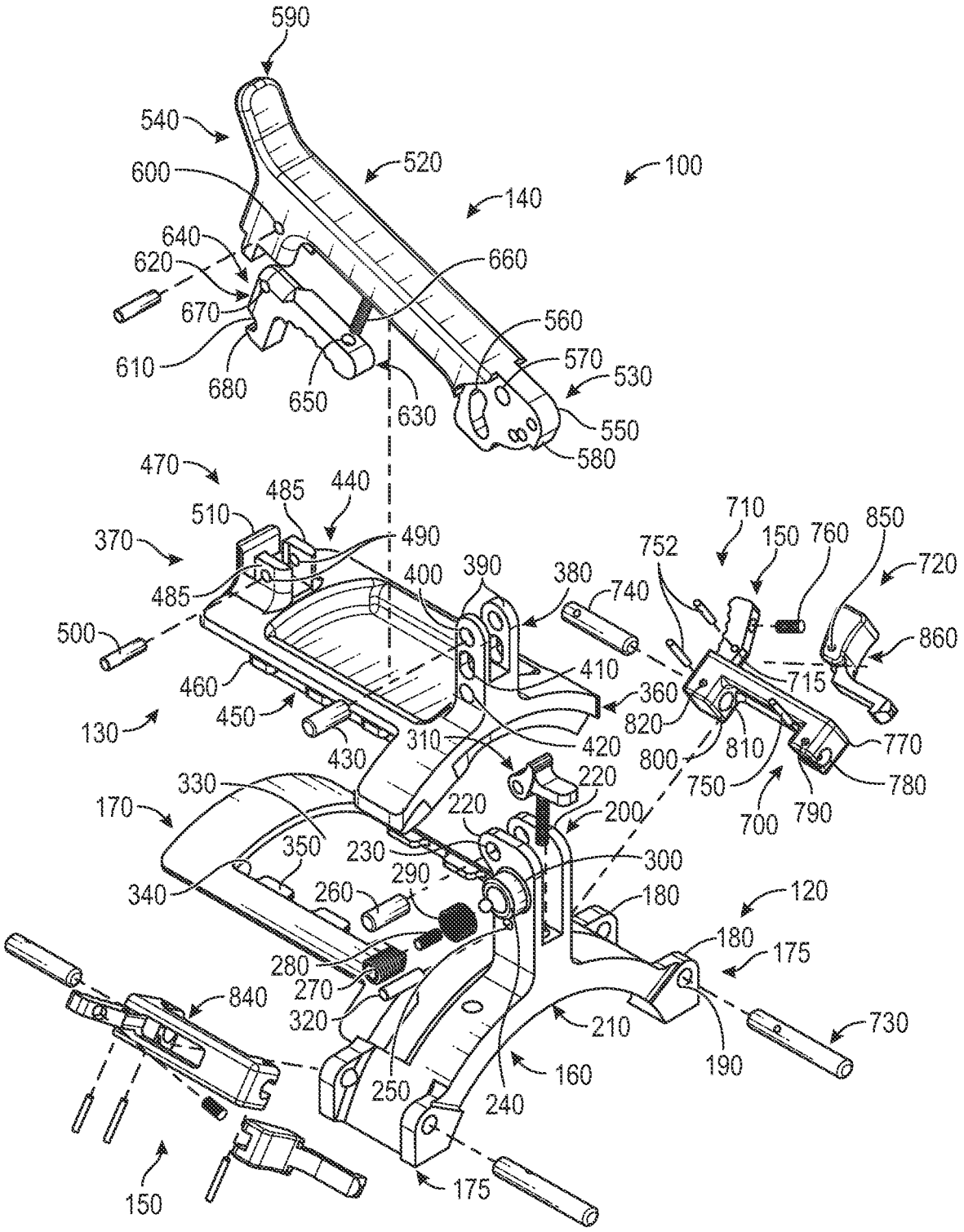
FIG. 4 is an exploded perspective view of the safing sector of FIGS. 1A-1D.
Figure 5A:
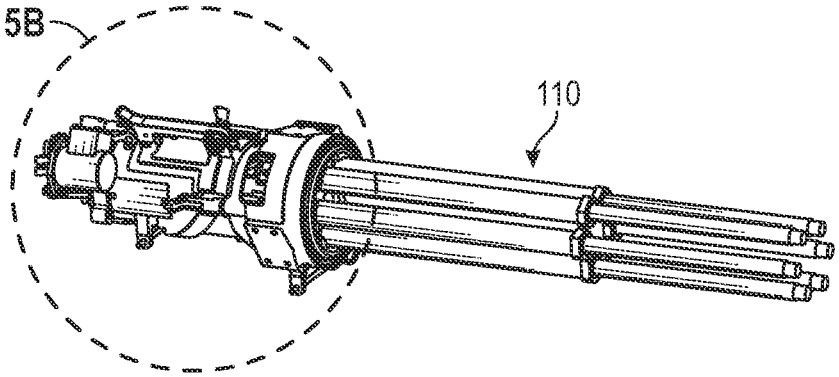
FIG. 5A is a perspective view of a M134 Minigun with the safing sector of FIGS. 1A-1D added thereto.
Figure 5B:
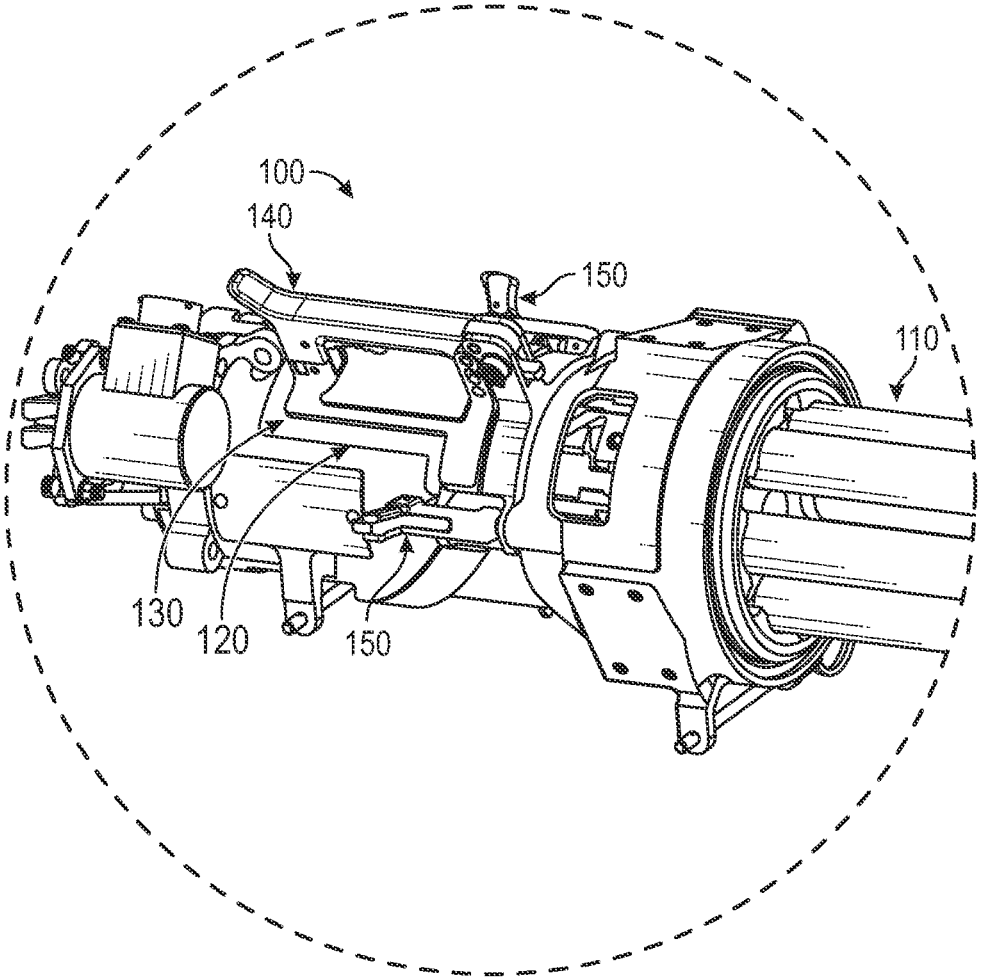
FIG. 5B is an enlarged partial perspective view of area 5B of the M134 Minigun and illustrates the safing sector of FIGS. 1A-1D.
Figure 6:
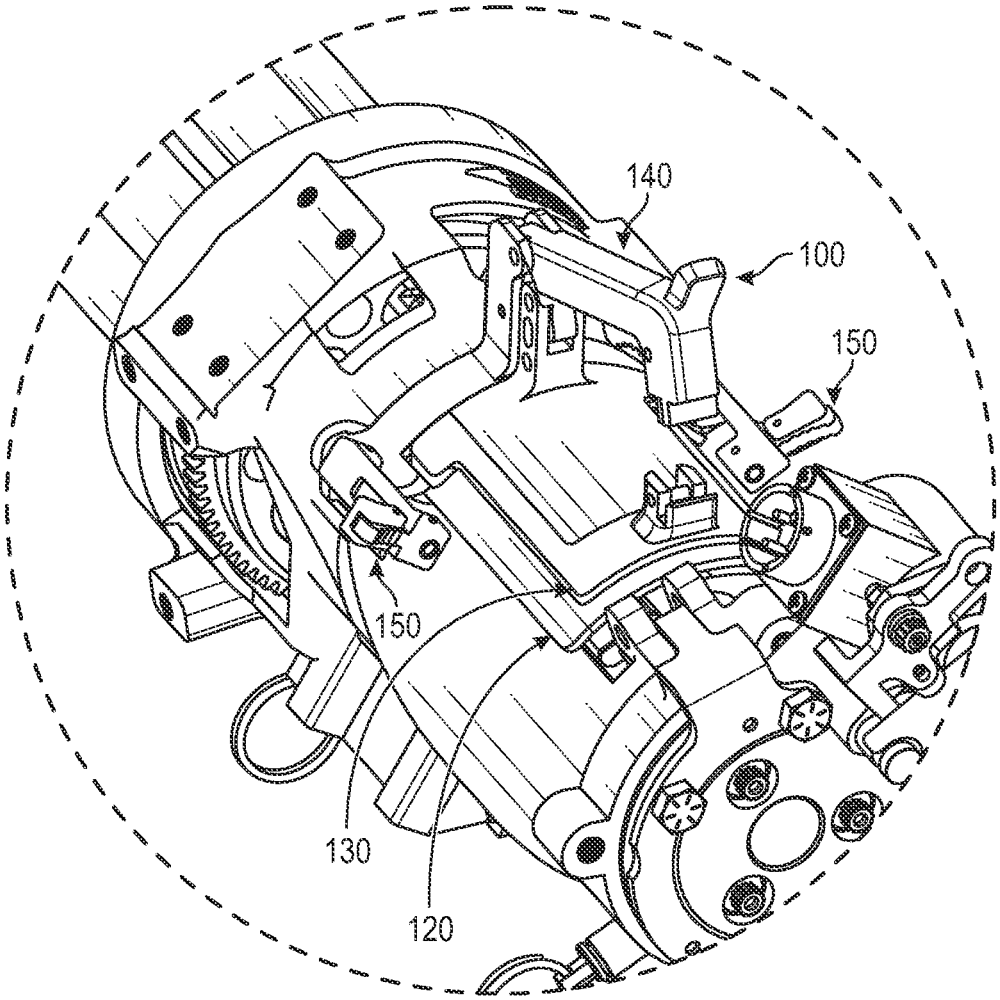
FIG. 6 is an enlarged perspective view of the M134 Minigun with the safing sector, similar to FIG. 5B, but with the safing sector shown in the safe or partial open position.
Figure 7:
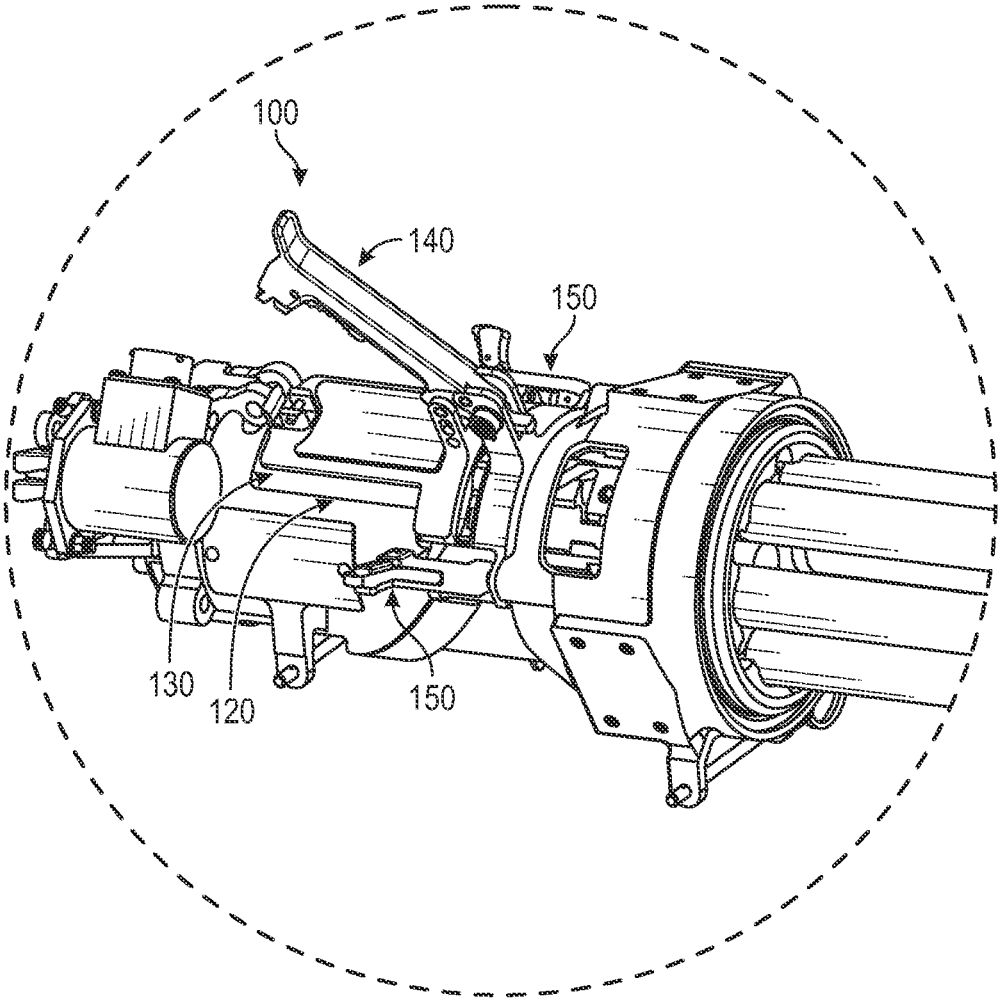
FIG. 7 is an enlarged perspective view of the M134 Minigun with the safing sector, similar to FIG. 5B, but with the safing sector shown in the install or fully open position.

The safing sector 100 is positioned in the install or fully open position shown in FIGS. 5A-5D and FIG. 7 by disengaging the ratchet stop 310 with respect to the end 530 of the locking arm 520 and lifting the safing sector slide control mechanism 140, including the locking arm 520, to the install or fully open position shown. Lifting of the locking arm 520 to the position shown causes the internal sidewalls of the portion of the locking arm 520 forming the elongated curved slot/hole 560 to slide over the dowel pin 430 so that the safing sector slide member 130 slides fully rearward. The safing sector slide member 130 slides rearward relative to the safing sector cover 120 via the outwardly extending guide members 460 of safing sector slide member 130 and the inwardly extending guide members 350 of the safing sector cover 120, and the operation of the safing sector slide control mechanism 140, including the locking arm 520. With reference to FIG. 3B, in the fully rearward position, as the barrels of the M134 minigun 110 rotate, the forward camming section 900 is removed from the overall length of the helical track, while aft camming section 910 is left in place. Consequently, the safing sector 100 can be quickly and easily added/installed or removed/uninstalled from the housing of the M134 minigun 110. When the safing sector 100 is removed from the housing of the M134 minigun 110, the retaining pin assemblies 150 are removed from the respective bores in the housing of the M134 minigun 110 by actuating the trigger sections 860 followed by removing the front locating pins 730 from the respective bores of the M134 housing. Once the retaining pin assemblies 150 are removed from the respective bores, the trigger sections 860 may be released so that the springs 760 urge the locating latches 720 back into their home position.

The safing sector 100 easily and quickly renders the M134 minigun 110 safe or fire without having to remove components from the assembly. The one inseparable assembly of the safing sector 100 compared to the six removable components of the prior safing sector that could be lost, rendering the minigun non-functional, prevents essential components from being lost. By not removing components and simply sliding the searing surface back, the minigun allows rotation without striking the primer while also preventing a jam in the minigun.

The figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in the following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

I claim:

1. A safing sector for a minigun including a housing with an opening adjacent to barrels of the minigun, the housing and the barrels defining a longitudinal direction of the minigun, comprising:

a safing sector cover configured to cover the opening of the housing of the minigun;

one or more retaining pin assemblies configured to retain the cover to the housing of the minigun;

a safing sector slide member configured to slide forward and rearward, in the longitudinal direction of the minigun, relative to the safing sector cover;

a safing sector slide control mechanism configured to impart the forward and rearward sliding movement of the safing sector slide member, in the longitudinal direction of the minigun, relative to the safing sector cover between at least a fire position and a safe position, where the barrels of the minigun may be rotated electrically without firing and without bolt assemblies becoming damaged.

2. The safing sector of claim 1, wherein the safing sector cover includes one or more guide members and the safing sector slide member includes one or more guide members operatively associated with the one or more guide members of the safing sector cover to enable forward and rearward sliding movement of the safing sector slide member relative to the safing sector cover.

3. The safing sector of claim 2, wherein the one or more guide members of the safing sector slide member includes a plurality of outwardly extending guide members and the one or more guide members of the safing sector cover includes a plurality of inwardly extending guide members.

4. The safing sector of claim 1, wherein the safing sector slide control mechanism includes a movable arm configured to impart forward and rearward sliding movement of the safing sector slide member relative to the safing sector cover.

5. The safing sector of claim 4, wherein the movable arm is configured to impart rearward sliding movement of the safing sector slide member relative to the safing sector cover when the arm is raised.

6. The safing sector of claim 4, wherein the movable arm is configured to impart forward sliding movement of the safing sector slide member relative to the safing sector cover when the arm is lowered.

7. The safing sector of claim 4, wherein the movable arm is configured to impart rearward and forward sliding movement of the safing sector slide member relative to the safing sector cover between at least two positions: a fire position, and a safe position.

8. The safing sector of claim 4, wherein the movable arm is configured to impart rearward and forward sliding movement of the safing sector slide member relative to the safing sector cover between at least three positions: a fire position, a safe position, and an install/uninstall position.

9. The safing sector of claim 4, wherein the movable arm includes a spring-loaded latch to latch and unlatch the movable arm relative to the safing sector slide member.

10. The safing sector of claim 1, wherein the safing sector slide control mechanism includes a cam mechanism configured to impart forward and rearward sliding movement of the safing sector slide member relative to the safing sector cover.

11. The safing sector of claim 1, wherein the one or more retaining pin assemblies include a spring-loaded latch to latch and unlatch the one or more retaining pin assemblies relative to the safing sector cover.

12. A method of using the safing sector of claim 1, comprising:

imparting forward and rearward sliding movement of the safing sector slide member, in the longitudinal direction of the minigun, relative to the safing sector cover with the safing sector slide control mechanism.

13. The method of claim 12, wherein the safing sector cover includes one or more guide members and the safing sector slide member includes one or more guide members operatively associated with the one or more guide members of the safing sector cover to enable forward and rearward sliding movement of the safing sector slide member relative to the safing sector cover, and the method further comprising sliding the safing sector cover forward and rearward relative to the safing sector cover via the one or more guide members of the safing sector slide member and the one or more guide members of the safing sector cover.

14. The method of claim 12, wherein the one or more guide members of the safing sector slide member includes a plurality of outwardly extending guide members and the one or more guide members of the safing sector cover includes a plurality of inwardly extending guide members, and sliding includes sliding the safing sector cover forward and rearward relative to the safing sector cover via the plurality of outwardly extending guide members of the safing sector slide member and the plurality of inwardly extending guide members of the safing sector cover.

15. The method of claim 12, wherein the safing sector slide control mechanism includes a movable arm configured to impart forward and rearward sliding movement of the safing sector slide member relative to the safing sector cover, and imparting includes imparting forward and rearward sliding movement of the safing sector slide member relative to the safing sector cover with the movable arm.

16. The method of claim 15, wherein the movable arm is configured to impart rearward sliding movement of the safing sector slide member relative to the safing sector cover when the arm is raised and is configured to impart forward sliding movement of the safing sector slide member relative to the safing sector cover when the arm is lowered, and imparting includes imparting forward and rearward sliding movement of the safing sector slide member relative to the safing sector cover with the movable arm by respectively lowering and raising the movable arm.

17. The method of claim 15, wherein the movable arm is configured to impart rearward and forward sliding movement of the safing sector slide member relative to the safing sector cover between at least a fire position and a safe position, and imparting includes imparting rearward and forward sliding movement of the safing sector slide member relative to the safing sector cover between at least the fire position and the safe position, where the barrels of the minigun may be rotated electrically without firing and without bolt assemblies becoming damaged.

18. The method of claim 15, wherein the movable arm is configured to impart rearward and forward sliding movement of the safing sector slide member relative to the safing sector cover between at least a fire position, a safe position, and an install/uninstall position, and imparting includes imparting rearward and forward sliding movement of the safing sector slide member relative to the safing sector cover between at least the fire position, the safe position, where the barrels of the minigun may be rotated electrically without firing and without bolt assemblies becoming damaged, and the install/uninstall position, where the safing section may be installed/uninstalled relative to the housing of the minigun.

19. The method of claim 12, wherein the safing sector slide control mechanism includes a cam mechanism configured to impart forward and rearward sliding movement of the safing sector slide member relative to the safing sector cover, and imparting includes imparting forward and rearward sliding movement of the safing sector slide member relative to the safing sector cover via the cam mechanism.

* * * * *